United States Patent [19]

Lynch

[11] Patent Number: 4,892,305

[45] Date of Patent: Jan. 9, 1990

[54] EXERCISING DEVICE

[76] Inventor: Peter G. Lynch, 166 Woodway, Glencairn, Cape Town, Cape Province, South Africa

[21] Appl. No.: 136,142

[22] Filed: Dec. 21, 1987

[30] Foreign Application Priority Data

Dec. 22, 1986 [ZA] South Africa ..... 86/9629

[51] Int. Cl.[4] ..... A63B 23/00

[52] U.S. Cl. ..... 272/127; 272/96; 272/93; 272/146

[58] Field of Search ..... 272/70, 70.3, 93, 127, 272/144, 145, 96, DIG. 4, 143, 146, 114, 33 A; 128/25 R, 25 B; D34/40, 5; D3/30.1; 446/71, 78, 73; 280/87.01, 87.02 R, DIG. 3, 87.04 R; D7/332, 334; 297/438, 462

[56] References Cited

U.S. PATENT DOCUMENTS

| | | | |
|---|---|---|---|
| D. 148,154 | 12/1947 | Failing | D7/334 |
| D. 278,021 | 3/1985 | Schlosser et al. | D7/332 |
| 478,166 | 7/1892 | Madsen | 272/96 |
| 1,497,243 | 6/1924 | Martin | 128/25 B |
| 1,824,920 | 9/1931 | Novak | 272/127 |
| 2,069,384 | 2/1937 | Ogden | 272/96 |
| 2,820,454 | 1/1958 | Wright | 272/96 X |
| 3,467,376 | 9/1969 | Feinberg | 272/144 X |
| 3,567,242 | 6/1969 | Miller | 272/144 X |
| 3,622,152 | 11/1971 | Place | 272/127 |
| 3,802,700 | 4/1974 | Mayo | 272/96 |
| 3,809,383 | 5/1974 | Jones | 272/57 J |
| 4,126,309 | 11/1978 | Crumley | 272/64 |
| 4,132,404 | 1/1979 | Wilson | 272/127 X |
| 4,134,584 | 1/1979 | Rosenbusch | 272/127 |
| 4,700,945 | 10/1987 | Rader | 272/127 |
| 4,801,140 | 1/1989 | Bergeron | 272/146 |

FOREIGN PATENT DOCUMENTS

| | | | |
|---|---|---|---|
| 2235884 | 3/1974 | Fed. Rep. of Germany | 272/146 |

*Primary Examiner*—Richard J. Apley
*Assistant Examiner*—H. Flaxman
*Attorney, Agent, or Firm*—Ladas & Parry

[57] ABSTRACT

An exercising device comprises a platform and a number of peripherally spaced caster wheels underneath the platform, for supporting a limb of a user on or against a supporting surface while permitting movement of the limb in any direction along the supporting surface. The platform has a lower body part which carries the caster wheels, and a removable upper part which can be removed or inverted to change the configuration of the upper surface of the platform. Straps are provided to secure the device to the user's limb.

7 Claims, 3 Drawing Sheets

EXERCISING DEVICE

FIELD OF THE INVENTION

This invention relates to an exercising device, and to a method of doing body exercises.

BACKGROUND OF THE INVENTION

Applicant is aware of an exercising device which comprises a handle bar with a hand-grip at each opposite end thereof, and a single wheel mounted on the handle bar between the hand-grips, the wheel being rotatable with respect to the hand-grips. In doing exercises with such a device, the user holds the device in both hands, each hand gripping one of the hand-grips, supports part of his body weight on a supporting surface via the wheel, and then moves the device about along the surface, making use of his muscles. As it is necessary to grip the device with both hands, the range of exercises that can be done is extremely limited.

It is an object of the present invention to provide an exercising device which is more versatile, and to provide a method of doing body exercises which permits of more variation.

SUMMARY OF THE INVENTION

According to the invention there is provided an exercising device which comprises a platform and three or more caster wheels underneath the platform, for supporting a limb of a user on or against a supporting surface while permitting movement of the limb in any direction along the supporting surface.

The height of the platform above the supporting surface, when the device is so supported, preferably does not exceed 10 cm.

The transverse extent of the platform may lie between 10 and 30 cm.

There may be at least six of said caster wheels, the caster wheels being arranged at or nrear the periphery of the platform and being spaced equally about the periphery.

The platform may have a convex upper surface.

The platform may comprise a lower body part which carries the caster wheels, and a removable upper part which can be removed, inverted, or interchanged with a differently shaped upper part, thereby to change the configuration of the upper surface of the platform.

The lower part may have a concave depression therein, and said upper part may have a convex upper surface and a concave lower surface, the degree of concavity of the depression being equal to or greater than the degree of convexity of the upper surface of the upper part.

The exercising device may include one or more straps for fastening the device to a limb of the user.

The invention extends to a method of doing body exercises, in which the person doing the exercises supports on of this limbs on or against a supporting surface via a platform which has three or more caster wheels engaging with the supporting surface, and moves the limb about by the use of his muscles so that the platform is displaced along the supporting surface.

The person may so support at least two of his limbs on or against the supporting surface, each via a separate one of such platforms with caster wheels.

BRIEF DESCRIPTION OF THE DRAWINGS

The invention will now be described in more detail, by way of example, with reference to the accompanying drawings.

In the drawings.

DETAILED DESCRIPTION OF PREFERRED EMBODIMENT

Figure 1:
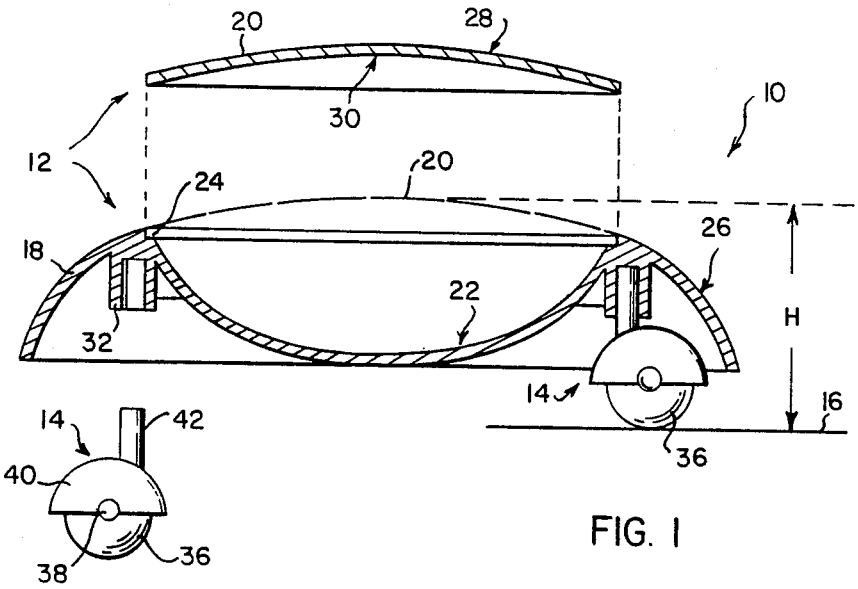
FIG. 1 is an exploded view of an exercising device in accordance with the invention, shown partly in vertical section.

Referring now to the drawings in more detail, reference numeral 10 generally indicates an exercising device which comprises a platform 12 and six caster wheels 14 underneath the platform for supporting the platform on or against a supporting surface 16.

The platform 12 is in two parts, namely a body part 18 which carries the caster wheels 14, and a removable upper part 20, both parts being plastics mouldings.

The body part 18 has a concave depression 22 therein and a ledge formation 24 around the periphery of the depression. The purpose of the ledge formation 24 is to support and laterally locate the upper part 20 when in position on the body part 18. Outwardly of the ledge formation 24, the body part has a convex surface 26. The upper part 20 has a convex upper surface 28 and a concave lower surface 30. When the upper part 20 is in position on the body part 18, as shown in dotted lines in FIG. 1, the convex upper surface 28 of the part 20 forms a continuation of the convex surface 26 of the body part.

On its underside, the body part 18 is formed with six peripherally spaced sockets 32, each reinforced by a gusset 34. Each of the caster wheels 14 comprises a spherical wheel 36 with stub axles 38, and a cowl 40 with an off-centre, upwardly extending swivel pin 42. The stub axles 38 are rotatable in recesses in the periphery of the cowl 40, and the swivel pin 42 is receivable in the corresponding socket 32 so as to be swivelable about a vertical axis.

The platform 18 has, in plan view, an outer diameter D of about 20 cm, and a maximum height H from the surface 16 of about 6 cm—that is when the upper part 20 is in position on the body part 18 with the convex surface 28 facing upwardly. The device can also be used wit the upper part 20 being inverted (i.e. with the concave surface 30 facing upwardly), or with the part 20 removed altogether. It will be seen that degree of concavity of the depression 22 is greater than that of the surface 30. This will permit the selection of three different surface cponfigurations for the platform 18, namelly (1) with the part 20 in position upright as shown in FIG. 1, (2) with the part 20 in position upside-down, and (3) with the part 20 removed altogether.

Figure 2:
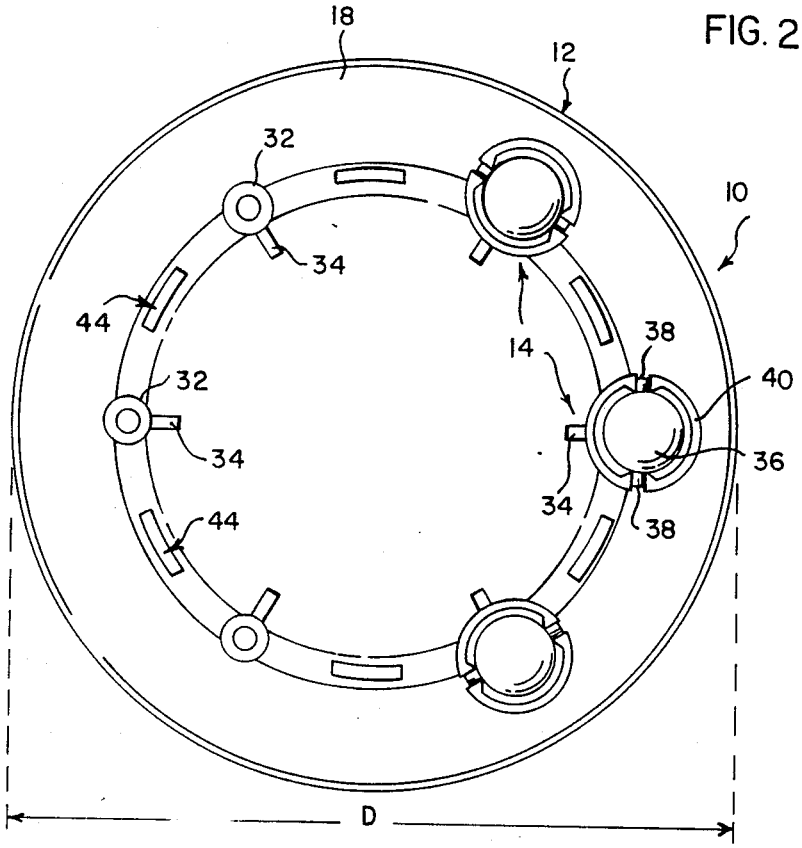
FIG. 2 is an underneath view of the exercising device, some of the caster wheels thereof having been removed to show the underlying structure.
Figure 3:
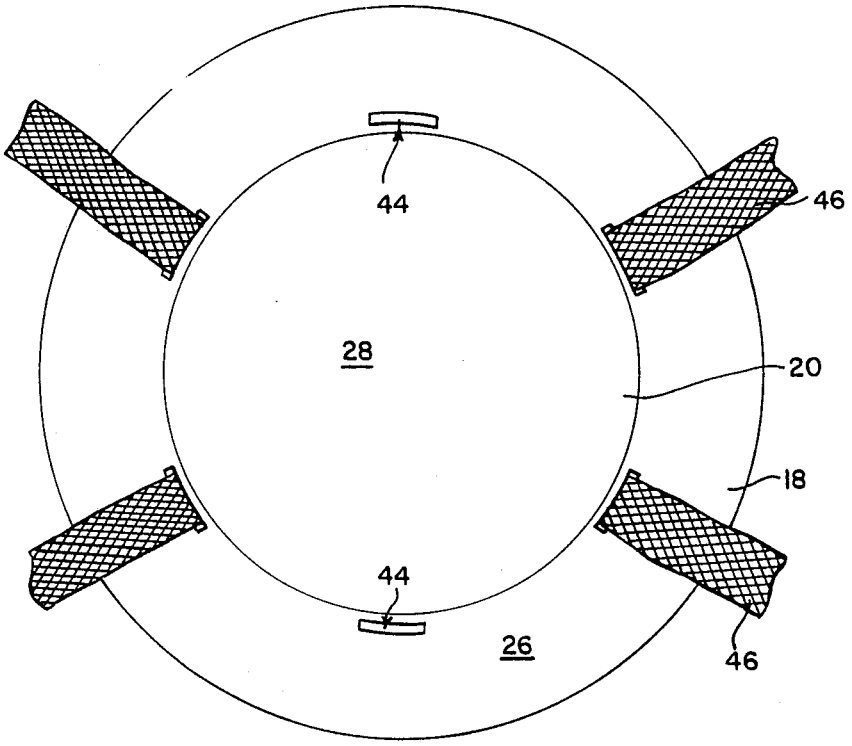
FIG. 3 is a top plan view of the device.

The body part 18 has a number of periphery space dslots 44 through which straps 46 (not shown in FIGS. 1 and 2) can pass for use in securing the device 12 to the limb of a user. This will make the device particularly suitable for use in break-dancing Various exercises can be done with one or more of the devices 12.

Figure 4:
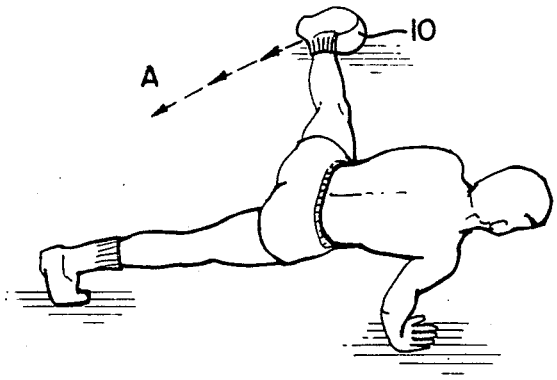
FIGS. 4 to 6 illustrate some of the many exercises that can be done with the device.

FIG. 4 illustrates a leg stretch exercise in which a single one of the devices 10 is used. The person doing the exercises is in a prone position, suporting his body off the ground with straight arms and legs. His two hands and his right foot are supported directly on the ground, while his left foot is supported on the gorund via the device 10. By making use of his muscles, the user now moves his left foot to and fro, in the direction of arrows A and back. In this exercise the part 20 of the device is positioned in the inverted position, to provide a relatively shallow concavity for the ball of the user's left foot.

Figure 5:
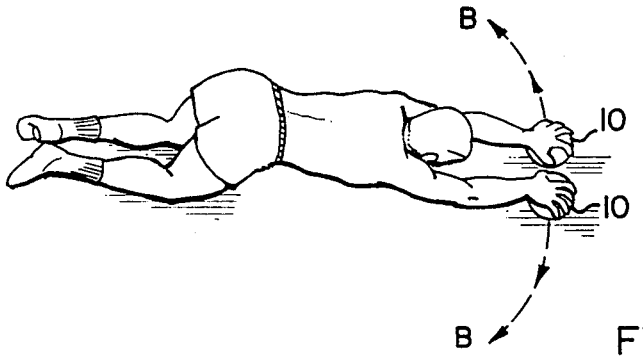

FIG. 5 illustrates a butterfly exercise in which two of the devices 10 are used. The person doing the exercises is in a kneeling position, with his knees and feet resting directly on the ground and his two hands each being supported on the ground via one of the devices 10. By making use of his muscles, the user now moves both his hands forwardly, then apart in the direction of arrows B, back towards one another in the direction opposite the arrows B, and rearwardly again. In this exercise the part 20 is in the upright position illustrated in FIG. 1, to provide a comfortable convex support surface for the palm of the user's hand.

Figure 6:
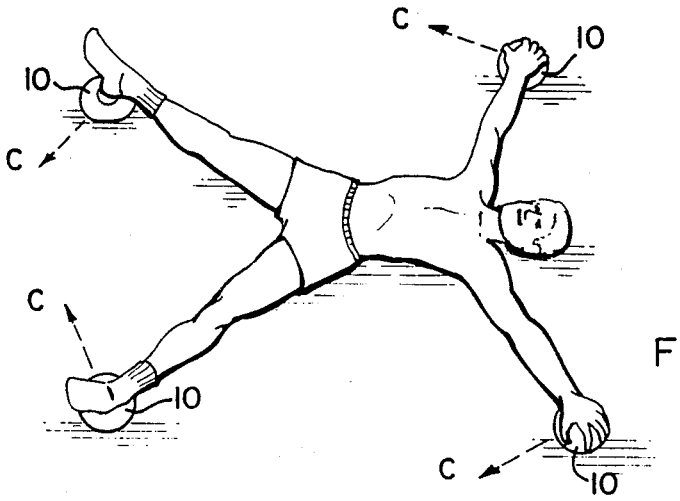

FIG. 6 illustrates a full scissors exercise in which four of the devices 10 are used. The person doing the exercises is in a supine position, with each of his feet and hands being supported on the ground via one of the devices 10 and with his buttocks off the ground. The user now moves his limbs to and fro, in the direction of arrows C and back. In this exercise the two devices 10 supporting the user's feet have their parts 20 removed, to provide a relatively deep concavity for the heel of the user's foot. The two devices 10 supporting the user's hands have their parts 20 in the upright position.

It will be appreciated that many more different exercises can be done with various combinations, of the devices 10.

I claim:

1. An exercising device which comprises a platform and three or more caster wheels underneath the platform, the for supporting a limb of a user on or against a supporting surface while permitting movement of the limb in any direction along the supporting surface:

the platform comprising a lower body part and a removable upper part;

the body part comprising a central portion having a concave uppper surface, and a skirt portion which extends peripherally of the central portion;

the central portion and the skirt portion defining between them, on the underside of the body part, a downwardly open annular recess;

the caster wheels being mounted underneath the body part so as to be partly accommodated in, and protrude downwardly from, said annular recess; and said upper part being such that, when supported in position on the body part, it extends across said concave upper surface. 7

2. An exercising device according to claim 1, wherein the height of the platform above the supporting surface, when the device is so supported, does not exceed 10 cm.

3. An exercising device according to claim 2, wherein the platform is circular in plan view and has a diameter of between 10 and 30 cm.

4. An exercising device according to claim 1, wherein there are at least six of said caster wheels, the caster wheels being arranged at equally spaced intervals along said annular recess.

5. An exercising device according to claim 1, wherein said upper part has a convex upper surface and said skirt portion has a convex outer surface, the arrangement being such that, when the upper part is in position on said body part the upper surface of the upper part co-extends with the outer surface of the skirt portion to form a continuous, substantially uninterrupted convex surface.

6. An exercising device according to claim 1, wherein said upper part has a concave lower surface, the degree of concavity of the upper surface of said central portion being equal to or greater than the degree of convexity of the upper surface of the upper part, and wherein the upper part can be supported in an inverted condition on the body part so that the concave lower surface of the upper part faces upwardly.

7. An exercising device according to claim 1, which includes one or more straps for fastening the device toa limb of the user.

* * * * *